US005221181A

United States Patent [19]

Ferleger et al.

[11] Patent Number: 5,221,181

[45] Date of Patent: Jun. 22, 1993

[54] STATIONARY TURBINE BLADE HAVING DIAPHRAGM CONSTRUCTION

[75] Inventors: Jurek Ferleger, Longwood; Shun Chen, Winter Springs, both of Fla.

[73] Assignee: Westinghouse Electric Corp., Pittsburgh, Pa.

[21] Appl. No.: 851,711

[22] Filed: Mar. 16, 1992

Related U.S. Application Data

[63] Continuation-in-part of Ser. No. 603,332, Oct. 24, 1990, and Ser. No. 624,367, Dec. 6, 1990.

[51] Int. Cl.[5] ..... F04D 29/56

[52] U.S. Cl. ..... 415/181; 415/191; 415/914

[58] Field of Search ..... 415/181, 191, 208.1, 415/914

[56] References Cited

U.S. PATENT DOCUMENTS

| | | | |
|---|---|---|---|
| 2,299,449 | 10/1942 | Allen | 415/208.1 |
| 3,953,148 | 4/1976 | Seippel et al. | 415/181 |
| 3,956,887 | 5/1976 | MacDonald | 415/181 |
| 4,012,165 | 3/1977 | Kraig | 415/181 |
| 4,504,189 | 3/1985 | Lings | 415/914 |
| 4,626,174 | 12/1986 | Sato et al. | 415/181 |
| 4,776,765 | 10/1988 | Sumner et al. | 415/181 |
| 4,958,985 | 9/1990 | Davids et al. | 415/914 |
| 4,968,216 | 11/1990 | Anderson et al. | 415/181 |

FOREIGN PATENT DOCUMENTS

| | | | |
|---|---|---|---|
| 451905 | 12/1945 | Canada | 415/181 |
| 2841616 | 3/1979 | Fed. Rep. of Germany | 415/914 |
| 2451453 | 11/1980 | France | 415/181 |
| 210125 | 8/1940 | Switzerland | 415/191 |
| 1511437 | 9/1989 | U.S.S.R. | 415/181 |
| 605361 | 7/1948 | United Kingdom | 415/181 |

*Primary Examiner*—John T. Kwon

[57] ABSTRACT

A steam turbine stationary blade diaphragm consisting of steam turbine blades with inner and outer rings which are integral with the blades to form a diaphragm structure of a particular design that avoids steam separation by selection of the blade parameters so as to cause a substantially continuous velocity increase over the major extent of the suction surface of the blade.

2 Claims, 10 Drawing Sheets

STATIONARY TURBINE BLADE HAVING DIAPHRAGM CONSTRUCTION

This application is a continuation in-part of co-pending application Ser. No. 07/603,332 filed Oct. 24, 1990 and co-pending application Ser. No. 07/624,367 filed Dec. 6, 1990, both assigned to the assignee of the present application.

BACKGROUND OF THE INVENTION

The present invention pertains to steam turbines for utility power application and, more particularly, to a stationary blade for use in a low pressure steam turbine.

Steam turbine rotor and stationary blades are arranged in a plurality of rows or stages. The rotor blades of a given row are identical to each other and mounted in a mounting groove provided in the turbine rotor. Stationary blades, on the other hand, are mounted on a cylinder or blade ring which surrounds the rotor.

Turbine rotor blades typically share the same basic components. Each has a root receivable in the mounting groove of the rotor, a platform which overlies the outer surface of the rotor at the upper terminus of the root, and an airfoil which extends outwardly from the platform.

Stationary blades also have airfoils, except that the airfoils of the stationary blades extend downwardly towards the rotor. The airfoils include a leading edge, a trailing edge, a concave surface, and a convex surface. In most turbines, the airfoil shape common to a particular row of blades generally differs from the airfoil shape in other rows within a particular turbine. In general, no two turbines of different designs share airfoils of the same shape. The structural differences in airfoil shape result in significant variations in aerodynamic characteristics, stress patterns, operating temperature, and natural frequency of the blade. These variations, in turn, determine the expected life of the turbine blade under the operating conditions (turbine inlet temperature, pressure ratio, and rotational speed), which are generally determined prior to airfoil shape development.

Development of a turbine for a new commercial power generation steam turbine may require several years to complete. When designing rotor blades for a new steam turbine, a profile developer is given a certain flow field with which to work. The flow field determines the inlet angles (for steam passing between adjacent blades of a row), gauging, and the force applied on each blade, among other things. "Gauging" is the ratio of throat to pitch; "throat" is the straight line distance between the trailing edge of one blade and the suction surface of an adjacent blade, and "pitch" is the distance in the tangential direction between the trailing edges of the adjacent blades, each measurement being determined at a specific radial distance from the turbine axis.

These flow field parameters are dependent on a number of factors, including the length of the blades of a particular row. The length of the blades is established early in the design states of the steam turbine and is essentially a function of the overall power output of the steam turbine and the power output for that particular stage.

Referring to FIG. 1, two adjacent blades of a row are illustrated in sectional views to demonstrate some of the features of a typical blade. The two blades are referred to by the numerals 10 and 12. The blades have convex, suction-side surfaces 14 and 16, concave pressure-side surfaces 18 and 20, leading edges 22 and 24, and trailing edges 26 and 28.

The throat is indicated in FIG. 1 by the letter "O", which is the shortest straight line distance between the trailing edge of blade 10 and the suction-side surface of blade 12. The pitch is indicated by the letter "S", which represents the straight line distance between the trailing edges of the two adjacent blades.

The width of the blade is indicated by the distance $W_m$, while the blade inlet flow angle is $\alpha 1$, and the outlet flow angle is $\alpha 2$.

"$\beta$" is the leading edge included metal angle, and the letter "s" refers to the stagger angle.

When working with the flow field of a particular turbine, it is important to consider the interaction of adjacent rows of blades. The preceding row affects the following row by potentially creating a mass flow rate near the base which cannot pass through the following row. Thus, it is important to design a blade with proper flow distribution up and down the blade length.

The pressure distribution along the concave and convex surfaces of the blade can result in secondary flow which results in blading inefficiency. These secondary flow losses result from differences in steam pressure between the suction and the pressure surfaces of the blades near the end walls.

Regardless of the shape of the airfoil as dictated by the flow field parameters, the blade designer must also consider the cost of manufacturing the optimum blade shape. Flow field parameters may dictate a profile which cannot be produced economically, and inversely the optimum blade shape may otherwise be economically impractical. Thus, the optimum blade shape should also take into account manufacturability.

SUMMARY OF THE INVENTION

In the present invention, a steam turbine blade has inner and outer rings which are integrally formed with an airfoil. A plurality of such blades are joined by welding the inner and outer rings to form an annular nozzle assembly. The diaphragm structure of the inventive blades offers improved performance over blades of similar length in that performance is improved due to smoother transition between the airfoil and the inner and outer rings as compared to conventional segmental assemblies in which a forged airfoil is welded to inner and outer rings. Furthermore, the present invention allows a thinner trailing edge and reduced manufacturing tolerances than is found in prior art segmental assemblies having forged airfoils with thick trailing edges and relatively large tolerance requirements. The particular design of the inventive blade also controls steam separation by control of the rate of change of convergence and turning angle. Steam velocity increases substantially continuously over the major extent of the suction surface of the blade to avoid flow separation.

DESCRIPTION OF THE PREFERRED EMBODIMENTS

Figure 2:
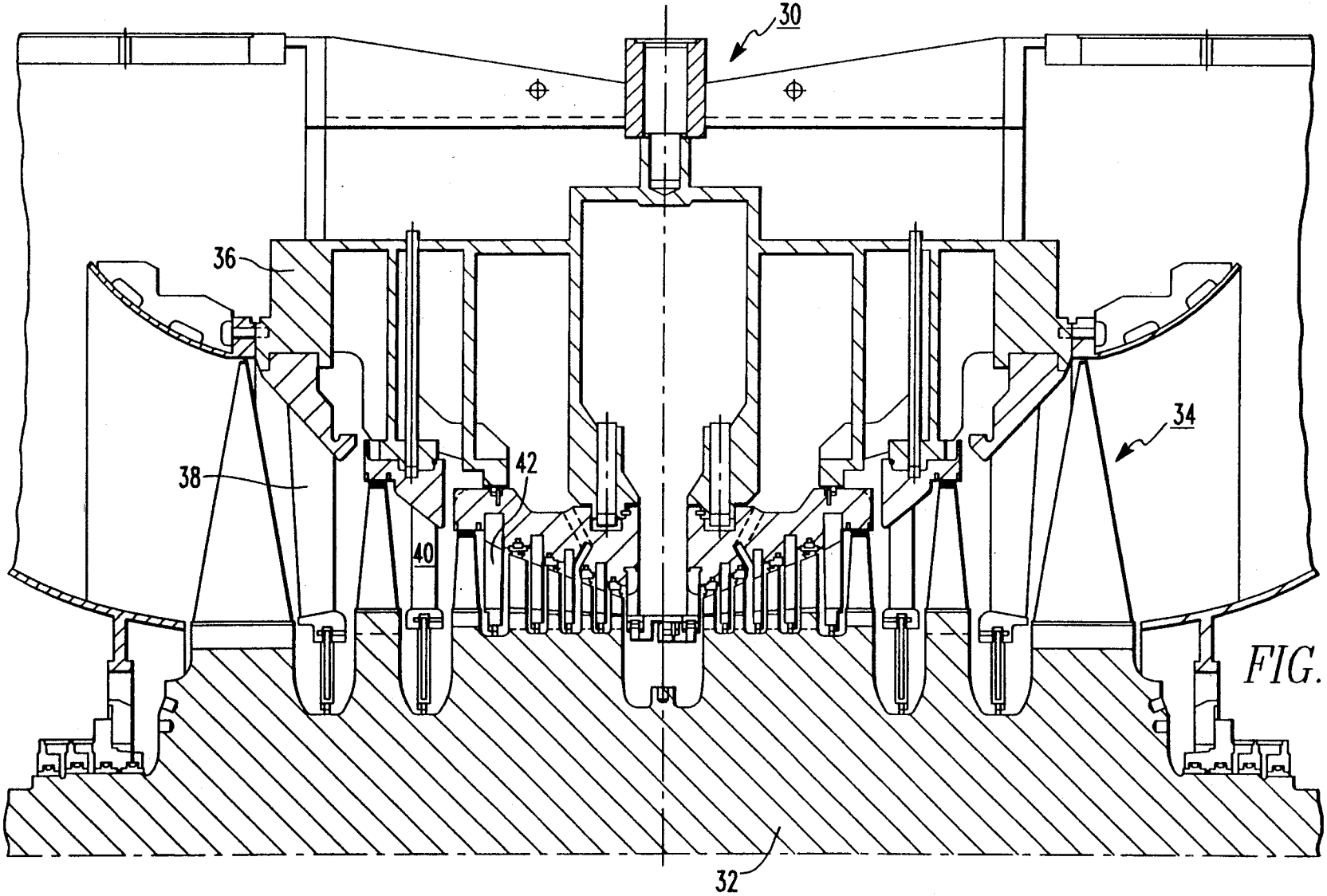
FIG. 2 is a vertical sectional view of a portion of a steam turbine incorporating a row of blades according to the present invention.

Referring to FIG. 2, a low pressure fossil fuel steam turbine 30 includes a rotor 32 carrying several rows or stages of rotary blades 34. An inner cylinder 36 carries plural rows of stationary blades, including a last row of stationary blades 38, next to last row of stationary blades 40 and a second from last row of stationary blades 42. Each row of blades has a row designation. Blade 38 is in row 7C, while the last row of rotary blades is designated 7R. The immediately upstream stationary blade 40 is in blade row 6C and the next stationary blade 42 is in blade row 5C. The present invention is particularly intended for use in row 5C.

Figure 3:
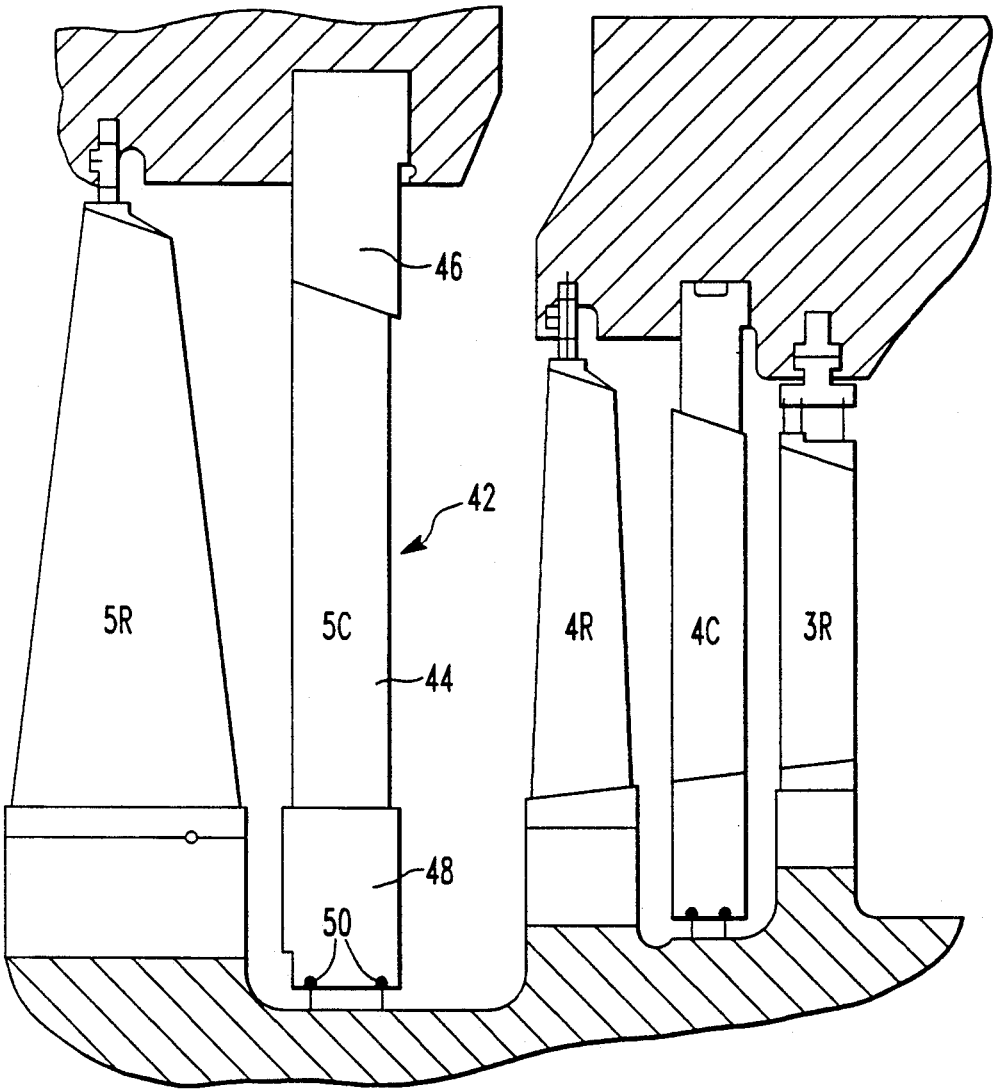
FIG. 3 is an enlarged view of a portion of the turbine of FIG. 2 illustrating a blade of the present invention.

As shown in FIG. 3, the blade 42 includes an airfoil portion 44, an outer ring 46 for connecting the blade to the inner cylinder 36, and an inner ring 48 connected to an "inner diameter" distal end of the airfoil portion 44. The "outer diameter" end of the airfoil portion 44 is formed integrally with the outer ring 46 in a diaphragm structure process. In a diaphragm structure, the airfoil, outer ring and inner ring are machined from an integral casting. Normally, a blade used in the 5C row, typically about 8.65 inches (219.71 MM), would be formed as a segmental assembly in which the inner and outer rings are welded to a separately formed airfoil. The diaphragm structure offers improved performance due to smoother airfoil to ring transitions, a thinner trailing edge on the airfoil and reduced manufacturing tolerances. A diaphragm assembly or nozzle assembly is formed by welding the inner and outer rings to adjacent rings to create an annular array of blades. The inner ring 48 is spaced from rotor 32 by a clearance gap. Seals 50 are positioned in the clearance gap to limit steam leakage under the stationary blades.

Figure 4:
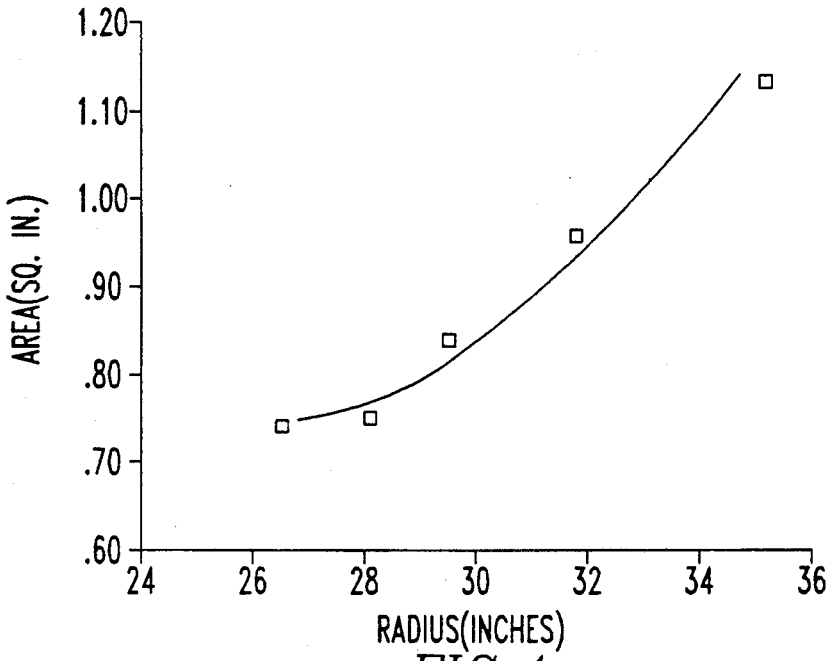
FIG. 4 is a graph of cross-sectional area as a function of radius for the blade of the present invention.
Figure 5:
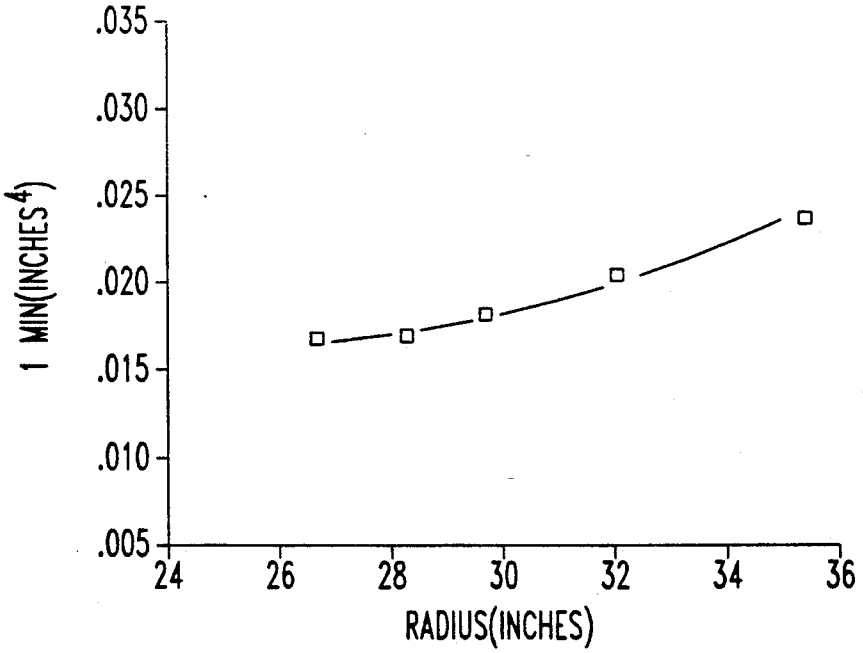
FIG. 5 is a graph of minimum moment of inertia (I_MIN) as a function of radius for the blade of the present invention.

The inner ring 48 and airfoil 44 have been constructed to tune the fundamental mode of the entire assembly between the multiples of turbine running speed, i.e., with respect to harmonic excitation frequencies, thus minimizing the risk of high cycle fatigue and failure. Specifically, the blade mass/stiffness is distributed in the radial direction to produce the characteristics shown in FIGS. 4 and 5. The fundamental harmonic frequency is then fine-tuned by optimizing the inner ring shape, i.e., by adjusting mass and stiffness.

In order to reduce the opportunity for high-cycle fatigue failure, the diaphragm blade structure is preferably analyzed by assuming full steam loading of the blade acting as in phase excitation. Such analysis can be done using a Goodman diagram technique normally reserved for rotating blade analysis. The vibratory stresses obtained from this analysis are then compared to empirically derived allowable stresses. If necessary, the blade structure can then be retuned and the analysis and comparison repeated until acceptable results are obtained. This technique has only been used for a blade of this type. Historically, diaphragm structures have only been tested for frequency response.

When the blades of the present invention are assembled into a blade row 5C, the efficiency of the blade row or stage is optimized by minimizing the steam flow incidence angle and secondary flow loss. The optimum inlet angle and gauging distributing are obtained using a quasithree dimensional flow field analysis. The unique shape of the airfoil 44 influences the flow conditions leaving rotating blade row 5R and the performance of the last two stages of the low pressure turbine 30. The inlet angles of blade row 5C are influenced by the condition of the steam leaving rotating blade row 4R.

Figure 1:
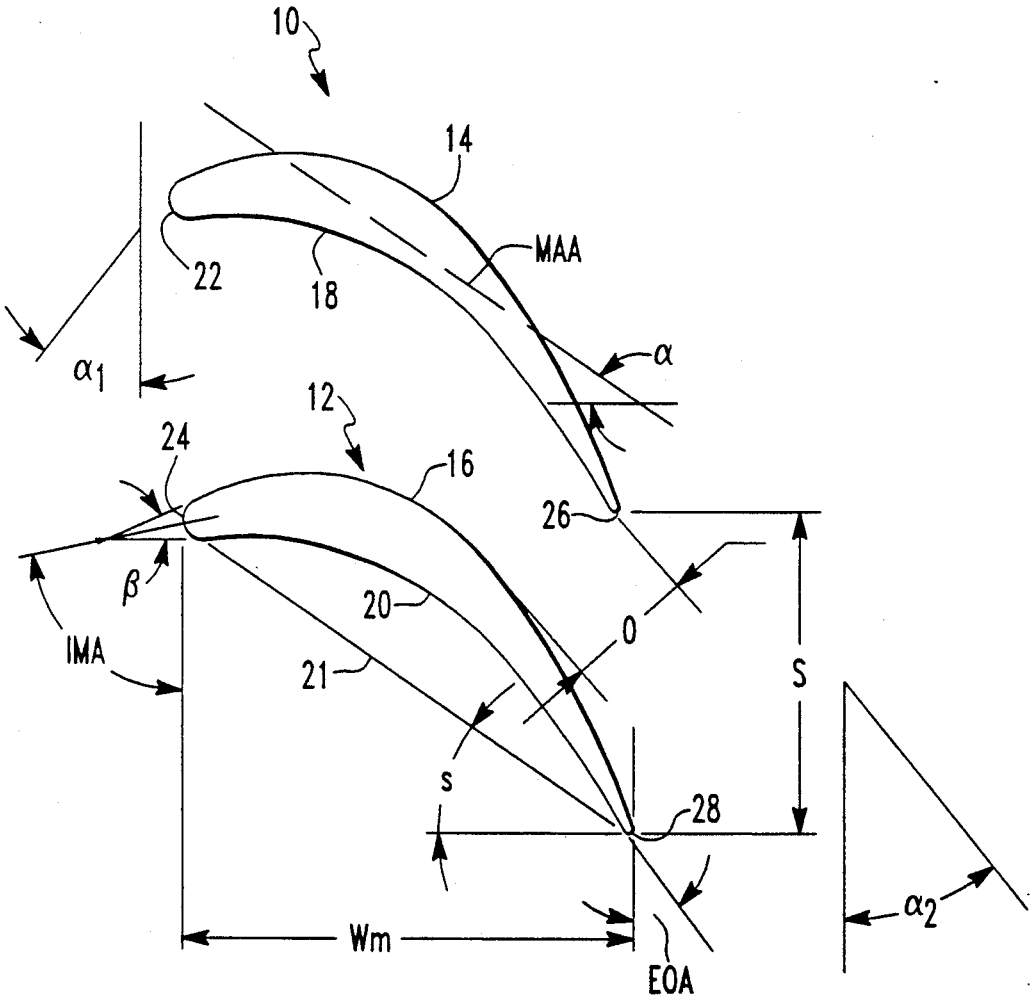
FIG. 1 is a sectional view of two adjacent blades illustrating typical blade features.
Figure 6A:
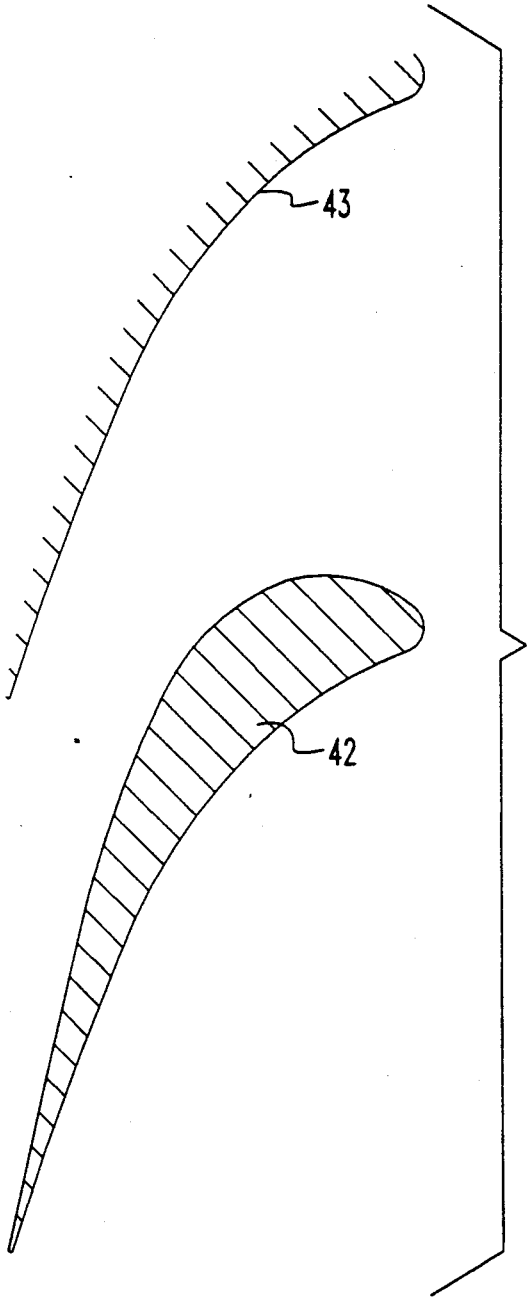
FIGS. 6(A)-(E) display an overlay of cross-sections of the blade of the present invention.
Figure 6B:
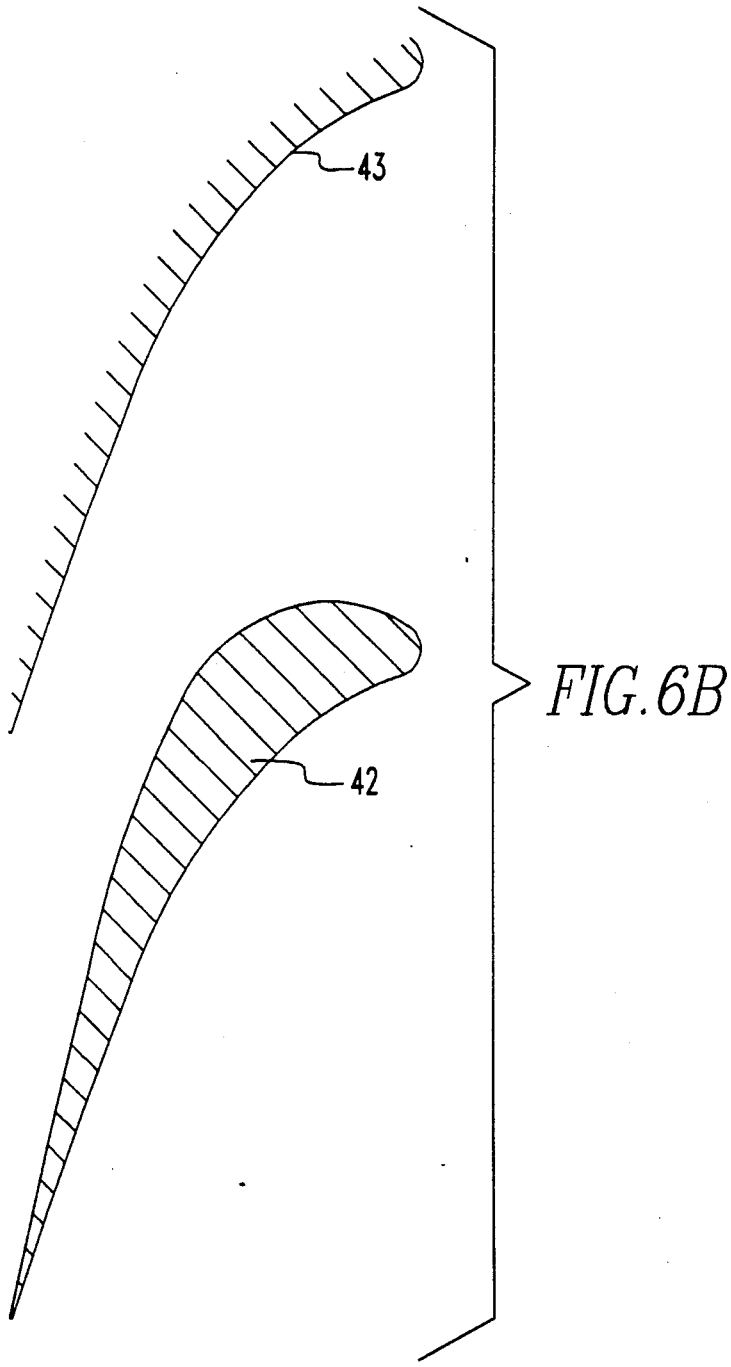
Figure 6C:
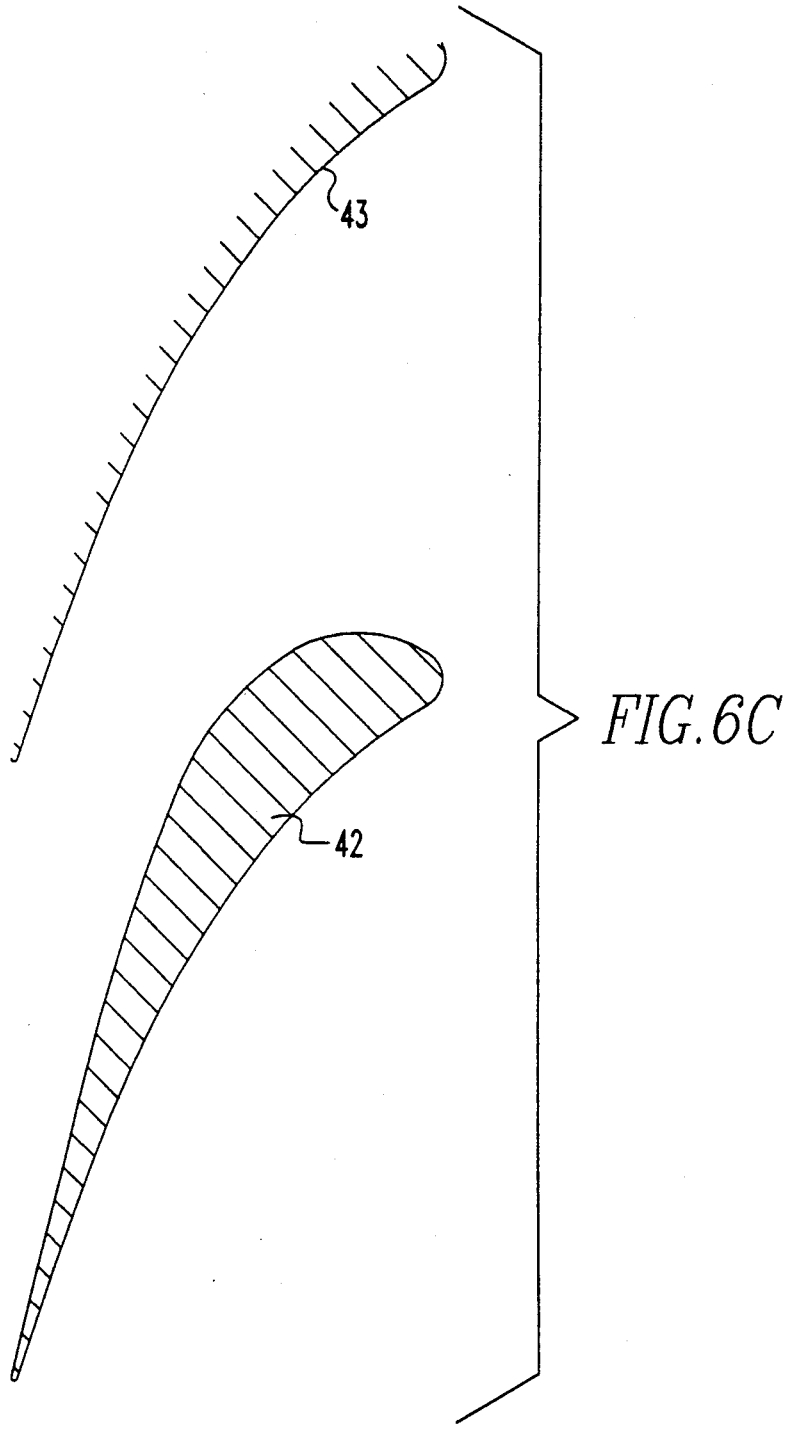
Figure 6D:
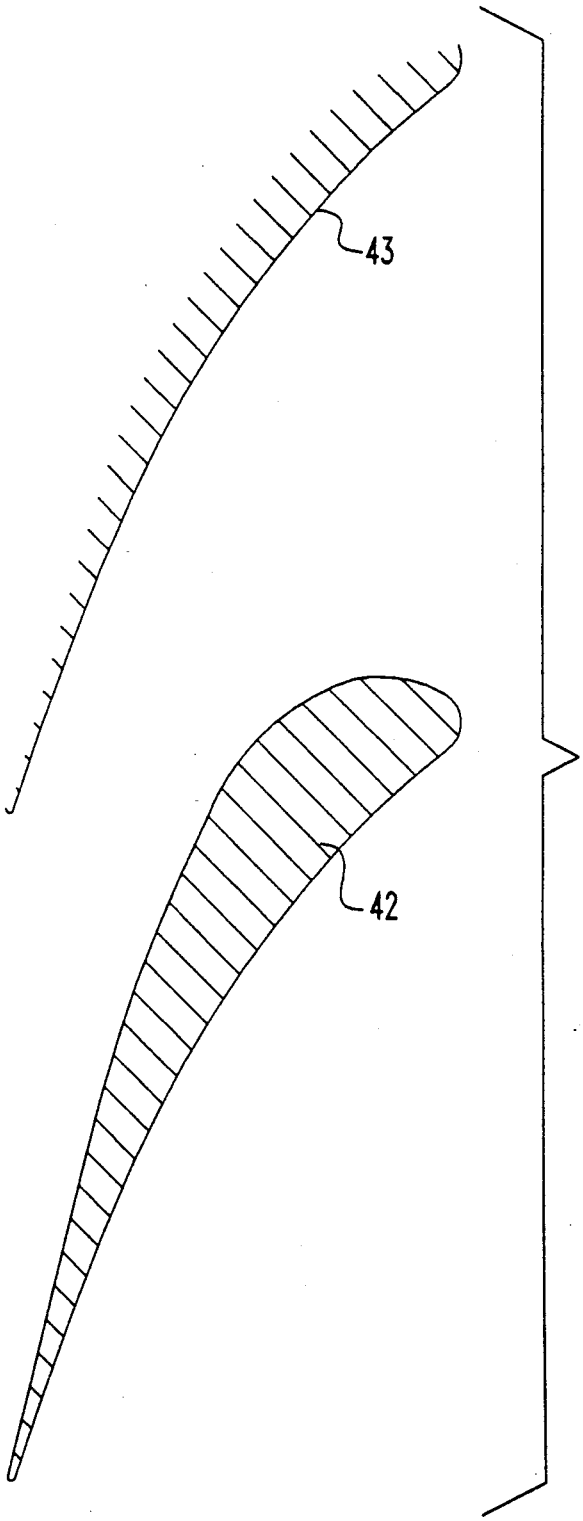
Figure 6E:
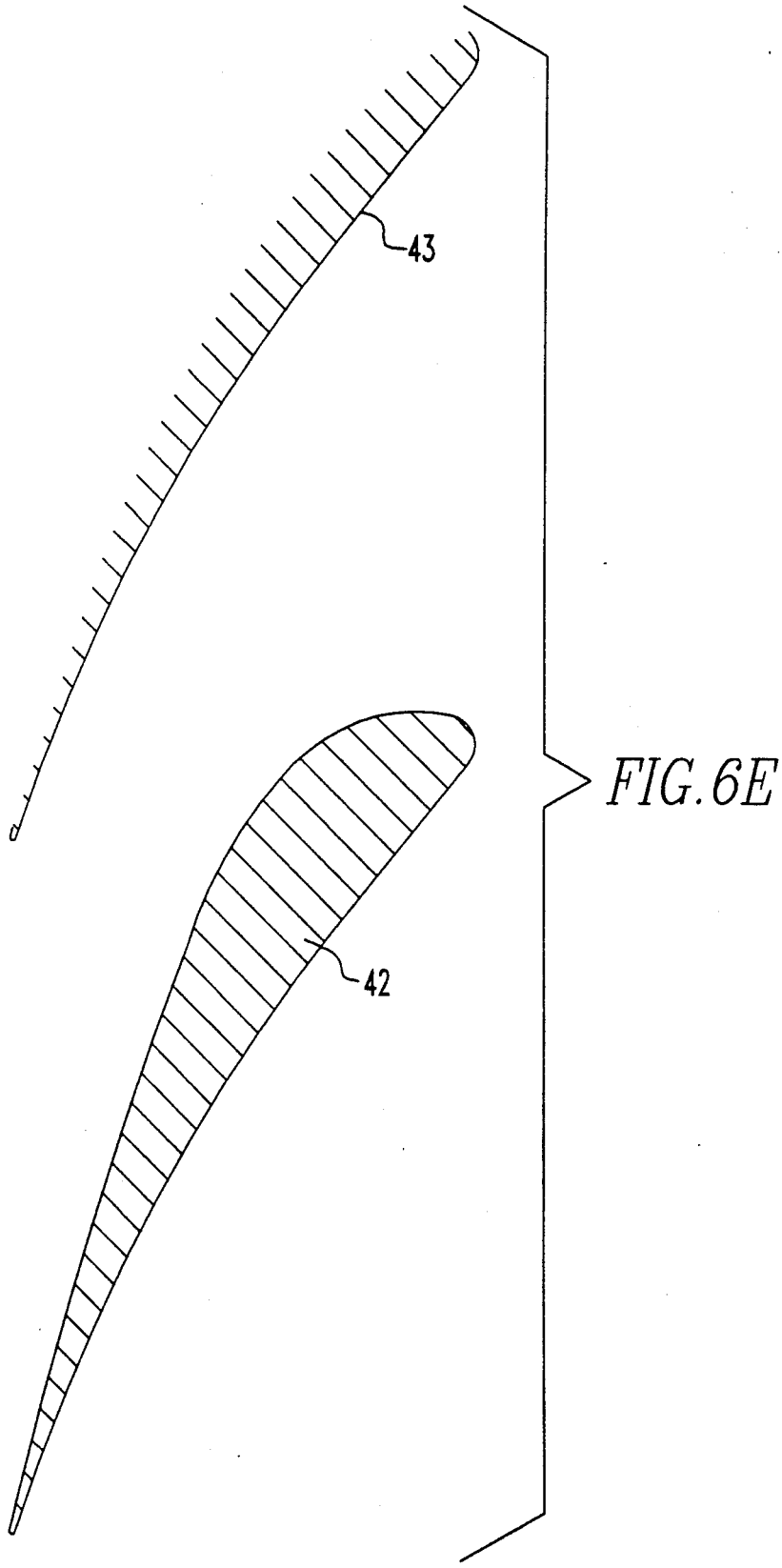

FIGS. 6A-6E show the general shape of the inventive blade 42 and the convergent configuration of the steam passage between blade 42 and an adjacent blade indicated by pressure-side profile line 43. The section of FIG. 6A is taken adjacent the radially inner end of the blade 42 (the tip end) and the section of FIG. 6E is taken adjacent the radially outer end (the base end) of blade 42. Table 1 lists the important characteristics of each of the sections of FIGS. 6A-6E in corresponding sequence. It will be noted that certain characteristics such as stagger angles (FIG. 1), exit opening angle and principal coordinate (alpha) angle EOA remain substantially constant over the extent of the airfoil 44. Stagger angles is the angle formed between a horizontal line and a line tangent 21 to leading and trailing edge circles in a cross-sectional view. The principal coordinate angles $\alpha$ is the angle between a horizontal line and a minimum second moment of area axis MAA. One measurement not listed in Table 1 is the nominal thickness of the blade trailing edge 44A. For the inventive blade, this thickness can be reached to about 80 mils for significantly reducing wake mixing loss and improving turbine performance. In referring to Table 1, it is noted that suction surface turning is the change in the slope of the suction surface from a throat point (the point where the minimum passage chord intersects the suction surface) to the exit of the airfoil. Inlet metal angle (IMA) as shown in FIG. 1 is the angle between the vertical direction and a bisecting line formed between the two tangent lines to the suction and pressure surfaces, respectively, at the leading edge tangency points. The inlet included angle is the angle between these two tangent lines. The exit opening is the shortest distance between adjacent airfoils at the steam passage exit.

TABLE 1

| | RADIUS (IN) | 26.63 | 28.25 | 29.70 | 32.00 | 35.26 |
|---|---|---|---|---|---|---|
| 1. | WIDTH (IN) | 1.71 | 1.77 | 1.81 | 1.89 | 1.99 |
| 2. | CHORD (IN) | 2.88 | 3.03 | 3.16 | 3.36 | 3.66 |
| 3. | PITCH/WIDTH | 1.16 | 1.20 | 1.23 | 1.27 | 1.33 |
| 4. | PITCH/CHORD | 0.69 | 0.70 | 0.70 | 0.71 | 0.72 |
| 5. | STAGGER ANGLE (DEG) | 52.85 | 53.66 | 54.31 | 55.23 | 56.39 |
| 6. | MAXIMUM THICKNESS | 0.45 | 0.44 | 0.47 | 0.51 | 0.56 |
| 7. | MAX THICKNESS/ CHORD | 0.16 | 0.15 | 0.15 | 0.15 | 0.15 |
| 8. | TURNING ANGLE | 80.31 | 79.42 | 74.53 | 65.38 | 52.88 |
| 9. | EXIT OPENING (IN) | 0.56 | 0.61 | 0.66 | 0.73 | 0.85 |

TABLE 1-continued

| | | | | | | |
|---|---|---|---|---|---|---|
| 10. | EXIT OPENING ANGLE | 24.36 | 23.43 | 24.84 | 25.59 | 25.34 |
| 11. | INLET METAL ANGLE | 82.57 | 82.57 | 87.33 | 96.27 | 109.72 |
| 12. | INLET INCL. ANGLE | 54.98 | 49.19 | 60.85 | 61.05 | 59.42 |
| 13. | GAUGING | 0.2855 | .2932 | .2991 | .3091 | .3238 |
| 14. | SUCTION SURFACE TURNING | 9.92 | 8.11 | 9.47 | 10.66 | 11.08 |
| 15. | AREA (IN**2) | 0.74 | 0.75 | 0.83 | 0.95 | 1.12 |
| 16. | ALPHA (DEG) | 54.24 | 55.50 | 55.56 | 56.60 | 57.33 |
| 17. | I MIN (IN**4) | 0.02 | 0.02 | 0.02 | 0.02 | 0.02 |
| 18. | I MAX (IN**4) | 0.32 | 0.36 | 0.42 | 0.55 | 0.73 |

Figure 7:
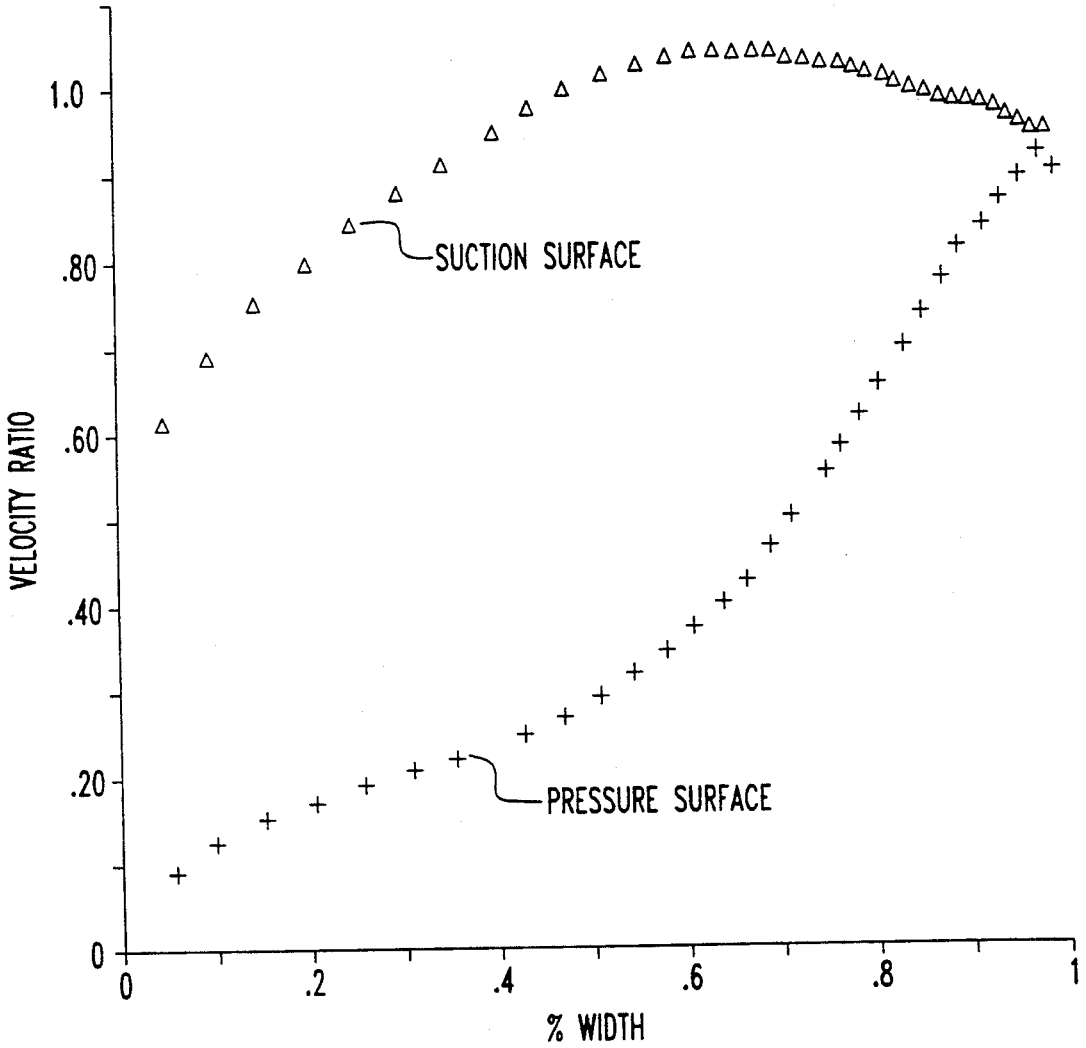
FIG. 7 is a graph of steam velocity at the suction surface and pressure surface of the blade of the present invention.

FIG. 7 illustrates another important characteristic of the present invention. As shown in FIG. 7, the velocity ratio of steam flow over the suction surface (convex surface) of blade airfoil 44 increases continuously over nearly the full width of the airfoil. This acceleration characteristic maintains the steam in contact with or closely spaced to the blade surface. Thus, this characteristic is achieved by the decreasing rate of convergence of the area between adjacent blades from leading to trailing edge and by controlling the rate of change of the turning angle. Turning angle is the amount of angular turning from inlet to exit of the blade.

The blade 42 provides improved performance and efficiency in fossil fueled steam turbines. It utilizes manufacturing and tuning techniques which are not believed previously applied to stationary blades of this dimension.

What is claimed is:

1. A stationary steam turbine blade diaphragm structure comprising blades having outer and inner integrally formed ring portions forming inner and outer diaphragm rings, each blade having a concave suction surface over substantially the full width of the blade such that steam flow over the suction surface continuously increases in velocity to near a trailing edge of the blade thereby avoiding flow separation along the suction surface, and each blade further having an alpha angle which is substantially constant from base end to tip end of the blade, a stagger angle which is substantially constant from base end to tip end of the blade, a rate of convergence of area between adjacent blades which decreases from leading to trailing edge of the blade, an inlet included angle which is smaller than ninety degrees, an inlet metal angle which increases from about 82 degrees at a tip end of the blade to about 109 degrees at a base end of the blade, a pitch/chord ratio which is substantially constant from the tip end to the base end of the blade, and a maximum thickness/chord ratio which is substantially constant from tip end to base end of the blade.

2. A steam turbine diaphragm according to claim 1 wherein, in cross-sectional areas at different radial locations, the blades have the following characteristics.

| | RADIUS (IN) | 26.63 | 28.25 | 29.70 | 32.00 | 35.26 |
|---|---|---|---|---|---|---|
| 1. | WIDTH (IN) | 1.71 | 1.77 | 1.81 | 1.89 | 1.99 |
| 2. | CHORD (IN) | 2.88 | 3.03 | 3.16 | 3.36 | 3.66 |
| 3. | PITCH/WIDTH | 1.16 | 1.20 | 1.23 | 1.27 | 1.33 |
| 4. | PITCH/CHORD | 0.69 | 0.70 | 0.70 | 0.71 | 0.72 |
| 5. | STAGGER ANGLE (DEG) | 52.85 | 53.66 | 54.31 | 55.23 | 56.39 |
| 6. | MAXIMUM THICKNESS | 0.45 | 0.44 | 0.47 | 0.51 | 0.56 |
| 7. | MAX THICKNESS/CHORD | 0.16 | 0.15 | 0.15 | 0.15 | 0.15 |
| 8. | TURNING ANGLE | 80.31 | 79.42 | 74.53 | 65.38 | 52.88 |
| 9. | EXIT OPENING (IN) | 0.56 | 0.61 | 0.66 | 0.73 | 0.85 |
| 10. | EXIT OPENING ANGLE | 24.36 | 23.43 | 24.84 | 25.59 | 25.34 |
| 11. | INLET METAL ANGLE | 82.57 | 82.57 | 87.33 | 96.27 | 109.72 |
| 12. | INLET INCL. ANGLE | 54.98 | 49.19 | 60.85 | 61.05 | 59.42 |
| 13. | GAUGING | 0.2855 | .2932 | .2991 | .3091 | .3238 |
| 14. | SUCTION SURFACE TURNING | 9.92 | 8.11 | 9.47 | 10.66 | 11.08 |
| 15. | AREA (IN**2) | 0.74 | 0.75 | 0.83 | 0.95 | 1.12 |
| 16. | ALPHA (DEG) | 54.24 | 55.50 | 55.56 | 56.60 | 57.33 |
| 17. | I MIN (IN**4) | 0.02 | 0.02 | 0.02 | 0.02 | 0.02 |
| 18. | I MAX (IN**4) | 0.32 | 0.36 | 0.42 | 0.55 | 0.73 |

* * * * *